US006491027B1

(12) United States Patent
Freudenberg et al.

(10) Patent No.: US 6,491,027 B1
(45) Date of Patent: Dec. 10, 2002

(54) METHOD OF DRIVING A CAPACITIVE ACTUATOR OF A FUEL INJECTION VALVE OF AN INTERNAL COMBUSTION ENGINE

(75) Inventors: Hellmut Freudenberg, Grossberg (DE); Hartmut Gerken, Nittendorf (DE); Martin Hecker, Laimerstadt (DE); Christian Hoffmann, Regensberg (DE); Richard Pirkl, Regensburg (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/668,491

(22) Filed: Sep. 25, 2000

(30) Foreign Application Priority Data

Sep. 23, 1999 (DE) ..... 19 945 670

(51) Int. Cl.[7] ..... F02M 51/06
(52) U.S. Cl. ..... 123/490
(58) Field of Search ..... 123/478, 490; 361/152, 154

(56) References Cited

U.S. PATENT DOCUMENTS 5,632,250 A * 5/1997 Kato et al. ..... 123/490
5,992,391 A * 11/1999 Yamakado et al. ..... 123/490
6,109,245 A * 8/2000 Egger et al. ..... 123/490
6,196,184 B1 * 3/2001 Przymusinski et al. ..... 123/299
6,234,150 B1 * 5/2001 Watanabe ..... 123/490
6,250,286 B1 * 6/2001 Hoenig et al. ..... 123/490
6,332,455 B1 * 12/2001 Sumida et al. ..... 123/490

* cited by examiner

*Primary Examiner*—Erick Solis
(74) *Attorney, Agent, or Firm*—Laurence A. Greenberg; Werner H. Stemer; Ralph E. Locher

(57) ABSTRACT

Method of driving a capacitive actuator of a fuel injection valve of an internal combustion engine for achieving a constant stroke of the actuator, in which the amounts of energy that are supplied to the actuator are determined in dependence on the fuel pressure acting on the actuator.

4 Claims, 1 Drawing Sheet

METHOD OF DRIVING A CAPACITIVE ACTUATOR OF A FUEL INJECTION VALVE OF AN INTERNAL COMBUSTION ENGINE

BACKGROUND OF THE INVENTION

Field of the Invention

The invention relates to a method of driving a capacitive actuator of a fuel injection valve of an internal combustion engine in a manner such that a constant stroke or displacement is obtained.

Various methods of driving capacitive actuators, in particular piezoelectric actuators, are known. When driving with a prescribed, constant amount of energy, the actuator may either execute a corresponding stroke or displacement or exert a specific force.

In the case of the valve concepts used for fuel injection valves and the tuning chosen at the same time, when there is low fuel pressure a low amount of energy is required to ensure a specific motion (elongation) of the capacitive actuator or the valve needle. When there is high fuel pressure, a great force is required at an early time in order to achieve rapid opening of the valve. This leads to the following problems when driving the actuator with a constant amount of energy:

The characteristic curves of the amounts of fuel for various fuel pressures cross one another, which makes the use of adaptive methods more difficult. At moderate and high fuel pressure, ensuring a very small amount of fuel is made more difficult, since the minimum driving time of the actuator cannot go below a certain value. In the operating range predominantly used, a higher amount of energy is supplied to the actuator than is required. This influences the service life of the actuator and the mechanical drive elements of the fuel injection valve and consequently their reliability.

SUMMARY OF THE INVENTION

It is accordingly an object of the invention to provide a method which overcomes the hereinafore-mentioned disadvantages of the heretofore-known methods of this general type in such a way that it is possible to supply the actuator with the amount of energy required for a desired stroke in every operating range and, as a result, to extend the service life of the actuator and of the mechanical drive elements of the fuel injection valve and to consequently increase their reliability.

With the foregoing and other objects in view there is provided, in accordance with the invention, a method of driving a capacitive actuator of a fuel injection valve of an internal combustion engine for achieving a constant stroke of the actuator, which includes determining an amount of energy that is supplied to the actuator in dependence on the fuel pressure acting on the actuator.

Rather than supplying a constant amount of energy to the actuator for a driving operation to achieve a desired stroke, the amount of energy is determined in dependence on the fuel pressure.

A constant stroke or displacement of the actuator in the entire operating range of the internal combustion engine is desirable in order to restrict the number of parameters required for determining the amount of injected fuel which is to be supplied to the internal combustion engine.

A desired amount of energy is supplied to the actuator by applying a charging voltage which is assigned to this amount of energy and is additionally dependent on the capacitance of the actuator at the time, or, when the charging voltage is known, by applying this voltage for a prescribed charging time.

Other features which are considered as characteristic for the invention are set forth in the appended claims.

Although the invention is illustrated and described herein as embodied in a method of driving a capacitive actuator of a fuel injection valve of an internal combustion engine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
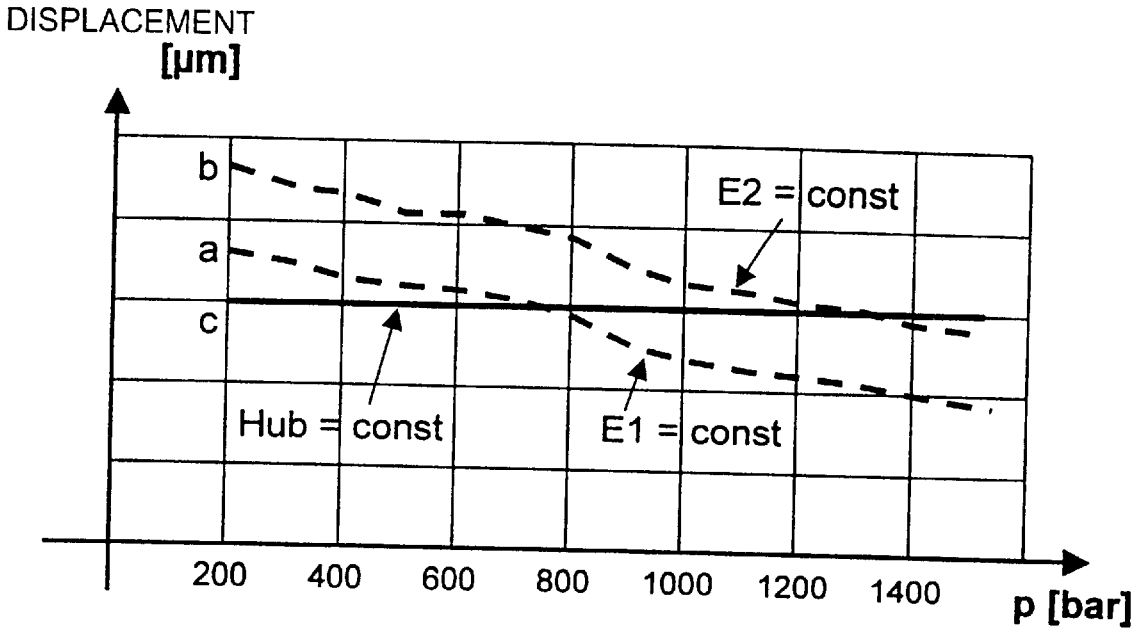
FIG. 1 shows a diagram in which the respective stroke or displacement of an actuator is represented as a function of the fuel pressure when the actuator is driven with constant amounts of energy in the entire fuel pressure range.

In the diagram according to FIG. 1, plotted on the x-axis is the fuel pressure p in bar, the operating range of which in a common-rail system lies for example between 200 bar and 1500 bar. Plotted on the y-axis is the stroke or displacement, which lies in the $\mu$m range, depending on the configuration of the actuator. If the actuator is driven with two different, constant amounts of energy E1 and E2, characteristics corresponding to the two broken curves a and b are obtained, which are measured over the entire pressure range. It can be seen from this that the stroke or displacement of an actuator that is driven with a constant amount of energy becomes increasingly smaller with increasing fuel pressure counteracting the actuator.

Figure 2:
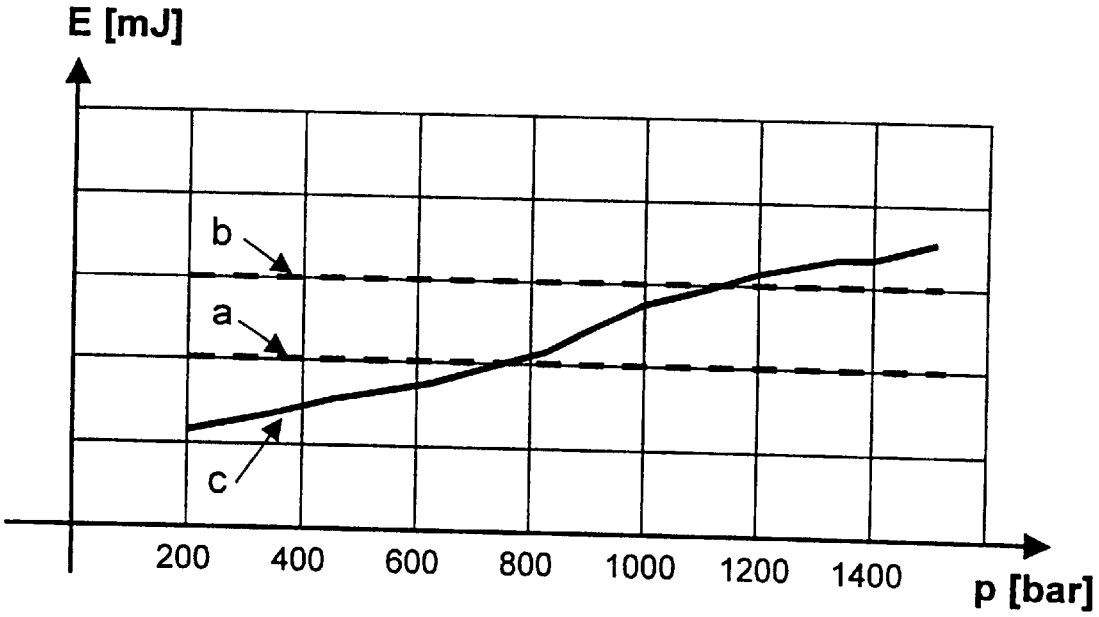
FIG. 2 shows a diagram of the amounts of energy with which an actuator is to be driven if it is to execute a constant stroke or displacement in the entire fuel pressure range.

In the diagram according to FIG. 2, the fuel pressure p is again plotted on the x-axis, and the energy E in mJ appears on the y-axis.

The two curves a and b from FIG. 1 appear in the diagram according to FIG. 2 as straight lines, since it has been assumed that the actuator is driven with constant amounts of energy in the entire fuel pressure range.

If it is then wished to achieve a constant stroke or displacement in the entire fuel pressure range, which is represented in FIG. 1 as solid straight line c, then amounts of energy that are assigned to the respective pressure are required for this, the characteristic of which is represented in FIG. 2 as solid curve c.

It can be seen that the amounts of energy which have to be supplied to the actuator for achieving a constant stroke or displacement over the entire fuel pressure range are proportional to the fuel pressure in a first approximation.

We claim:

1. A method of driving a capacitive actuator of a fuel injection valve of an internal combustion engine for achieving a constant stroke of the actuator, which comprises determining an amount of energy that is supplied to an actuator in dependence on the fuel pressure acting on the actuator.

2. The method according to claim 1, wherein the amount of energy supplied to the actuator is proportional to the fuel pressure in a first approximation.

3. The method according to claim 1, which comprises supplying the amount of energy to the actuator by applying to the actuator a charging voltage that is assigned to this amount of energy and that is additionally dependent on a capacitance of the actuator.

4. The method according claim 1, which comprises supplying the amount of energy to the actuator by charging the actuator for a prescribed charging time, when the charging voltage is known.

* * * * *